United States Patent [19]

Lang

[11] Patent Number: 4,823,890

[45] Date of Patent: Apr. 25, 1989

[54] REVERSE CIRCULATION BIT APPARATUS

[75] Inventor: Alan F. Lang, Sandy, Utah

[73] Assignee: Longyear Company, Salt Lake City, Utah

[21] Appl. No.: 159,358

[22] Filed: Feb. 23, 1988

[51] Int. Cl.[4] ..... F21B 21/10; F21B 21/12

[52] U.S. Cl. ..... 175/318; 175/215; 137/515

[58] Field of Search ..... 175/317, 215, 318, 339, 175/340, 235; 137/515

[56] References Cited

U.S. PATENT DOCUMENTS

| | | | |
|---|---|---|---|
| Re. 27,316 | 3/1972 | Elenburg | 175/339 |
| 1,874,070 | 8/1932 | Wellensieh | 175/340 |
| 2,293,259 | 8/1942 | Johnson | 175/340 X |
| 3,236,319 | 2/1966 | Brown | 175/317 X |
| 3,292,719 | 12/1966 | Schumacher, Jr. | 175/339 |
| 3,416,618 | 12/1968 | Kunnemann | 175/339 |
| 3,419,092 | 12/1968 | Elenburg | 175/339 X |
| 3,439,757 | 4/1969 | Elenburg | 175/215 |
| 3,685,601 | 8/1972 | Hollingshead | 175/318 |
| 3,784,264 | 1/1974 | Jackson, Jr. | 175/227 X |
| 3,948,330 | 4/1976 | Langford, Jr. | 175/339 |
| 4,158,973 | 6/1979 | Schumacher, Jr. et al. | 175/375 X |
| 4,682,661 | 7/1987 | Hughes et al. | 175/318 X |

FOREIGN PATENT DOCUMENTS 185300 10/1966 U.S.S.R. .

*Primary Examiner*—Jerome W. Massie, IV
*Assistant Examiner*—David J. Bagnell
*Attorney, Agent, or Firm*—Clayton R. Johnson

[57] ABSTRACT

A reverse circulation deep hole rock bit that includes a drill bit connector tube telescopically extended into a drill bit housing to cooperatively form a part of a radial inner fluid channel for cuttings to flow axially outwardly and a radial outer annular clearnace space, a plurality of angularly spaced pressurized fluid passage that open to the annular space and a check valve in each fluid fluid passage to permit inward flow of fluid, but to block fluid flow in the opposite direction. A plurality of angularly spaced cutter arms have arcuate tubular segments secured to axial and radial outer portions of the arms while a radially inner tubular skirt is secured to or abuts against the axial outer portions of the arms. The combination of segments, arms and skirt are secured to the housing to extend inwardly thereof with the skirt forming part of the radial inner return channel while each passage opens to a separate chamber angularly between adjacent arms to direct pressurized fluid to flow between the rotary cutters that are mounted by the arms and convey cuttings outwardly through the radial inner fluid channel.

10 Claims, 1 Drawing Sheet

REVERSE CIRCULATION BIT APPARATUS

BACKGROUND OF THE INVENTION

Drill bit apparatus adapted for use with a dual tube reverse circulation drill string.

In U.S. Re Pat. No. 27,316 to Elenburg there is disclosed a drill bit for a dual pipe reverse circulation system to greatly restrict radial outward flow. The drill bit housing has a depending tubular skirt with cone mounting extensions extending radially inwardly thereof. Radial inner housing extensions extend slightly inwardly of the axial outer portions of the cutters. A nozzle opens on each angular side of each cone mounting extension to discharge fluid inwardly adjacent to and radially inwardly of the skirt to cause cuttings to flow outwardly through the bit central opening. U.S. Pat. No. 3,439,757 to Elenburg discloses another reverse circulation bit that includes a radial outer skirt and weirs extending between the cutter cone shanks with fluid flowing inwardly between the shanks, skirt and and weir and thence radially inwardly to the bit housing central opening.

U.S. Pat. No. 3,685,601 to Hollingshead discloses a non-reverse circulation bit that has passages for discharging fluid downwardly between the exterior surfaces of rotary cutters and a check valve in each passage to prevent fluid returning into the interior of the bit. The bit also has cooling passages for conducting fluid between the pintles and cutters. U.S.S.R. Patent No. 185,300 discloses a roller bit having scavenging channels and a diaphragm with one or more ball check valves in the upper recess above the channels to obstruct entry of cuttings passing into the channels through the clearance space between the leg deflectors and cutters after air feed is stopped.

U.S. Pat. No. 1,874,070 to Wellensieh discloses a collar bit having a plurality of cutter mounting arms secured to an annular cutter head to extend thereabove and radially outwardly thereof in angularly spaced relationship while U.S. Pat. No. 3,292,719 to Schumacher, Jr. discloses cutter assemblies welded to the lower surface of a bit head with the cutters, for the most part, located in the annular space radially between the outer and central skirts. Fluid is forced inwardly exterior of the drill string.

In order to provide an improved reverse circulation bit and permitting drilling deeper bore holes to recover core cuttings in a shorter perior of time this invention has been made.

SUMMARY OF THE INVENTION

Reverse circulation bit apparatus adapted for use with a dual pipe drill string that includes a drill bit having an axial inner transverse surface, a radially central bore extending axially therethrough that includes a bore portion opening through said surface for conducting pressurized fluid inwardly, a check valve in each passage to block flow of fluid outwardly therethrough and a cutter head assembly secured to the drill bit housing to extend inwardly thereof, the cutter head assembly including a plurality of cutter arms, arcuate segments and a skirt to form a chamber arcuately between each pair of angularly adjacent cutter arms that opens to the respective passage and between the cutter arms.

One of the objects of this invention is to provide a new and novel reverse circulation bit. In furtherance of the above object it is another object of this invention to provide in the bit new and novel means to conduct fluid inwardly from an annular clearance space to discharge pressurized fluid adjacent to the cutters and to block reverse flow back to the annular chamber. Still another object of this invention is to provide a new and novel reverse circulation rock bit that is relatively compact while still providing valve means for blocking reverse flow through passages that provide for discharging pressurized fluid adjacent to and between each of the cutters without undesired reduction of the cross sectional area of the core cutting passage.

For purposes of facilitating the description of the invention, the term "inner" refers to that portion of the drill string, or of the assembly, or an element of the assembly being described which in its position "for use" in, or on, the drill string is located closer to the drill bit end of the drill string (end opposite the surface on which the drill rig being used is located) than any other portion of the apparatus being described, except where the term clearly refers to a transverse circumferential, direction, or diameter of the drill string or other apparatus being described. The term "outer" refers to that portion of the drill string, or of the assembly, or an element being described which in its position of "for use" in or on the drill string is located axially more closely adjacent to the surface on which the drill rig being used than any other portion of the apparatus being described, except where the term clearly refers to a transverse circumferential, direction or diameter of the apparatus being described.

Figure 4:
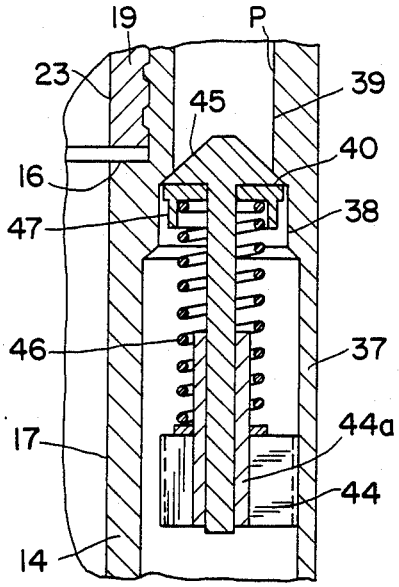
FIG. 4 is an enlarged longitudinal sectional view of the valve assembly and the adjacent part of the drill string.

Referring to the drawings, the drill bit apparatus of this invention, generally designated 10, includes an axially elongated bit housing 14 having a radially central bore 13, 15, 17 extending axially therethrough to open through the housing inner and outer transverse surfaces. The central bore includes an outer Portion 13 that is adapted for being extended into and threadly attached to the inner end of the radially outer tube 18 of a dual tube drill string, generally designated 11. The housing central bore includes an intermediate diameter bore portion 15 that opens to bore portion 13 to form an outwardly facing shoulder 16 against which an axially intermediate outer diameter portion of the bit connector tube 19 abuts to limit the inward movement of the tube 19 relative to the housing. The connector tube axial inner reduced diameter portion is telescopically extended into the housing intermediate bore portion 15 with O-rings provided in radially outer grooves in the tube 19 to form a fluid seal with the peripheral wall defining the intermediate bore portion 15.

The connector tube is of an axial length to extend outwardly of the bit housing and has a central cutting return bore 23 extending axially therethrough. Bore 23 has an inner bore portion of substantially the same diameter as the reduced diameter bore portion 17 and an outer bore Portion to telescopically receive the inner portion of the radially inner tube 24 of the drill string. The inner peripheral wall 18*a* of the drill string radial outer tube and the outer peripheral wall of the axial intermediate part of the connector tube forms an annular space 25 that opens to the shoulder 16.

Joined to the inner end of the bit housing to prevent radial fluid flow therebetween is a bit head assembly H. Assuming the head assembly H has three conventional rotary cutters 30 such as shown, there are provided three axially elongated cutter mounting arms 31 that each is equally angularly spaced from the other two arms. Each arm advantageously has an arcuately curved radially outer surface of a radius of curvature substantially the same as the outer diameter of the bit housing throughout its axial length. Further each arm has an axially and radially extending inner end portion 31*a* that rotatably mounts the somewhat conical cutters 30 to rotate about axes that are inclined to extend axially outwardly in a radial direction. Advantageously each arm has a conventional lubricant reservoir 32 with a passageway 50 for conducting lubricant to the respective cutter.

Figure 1:
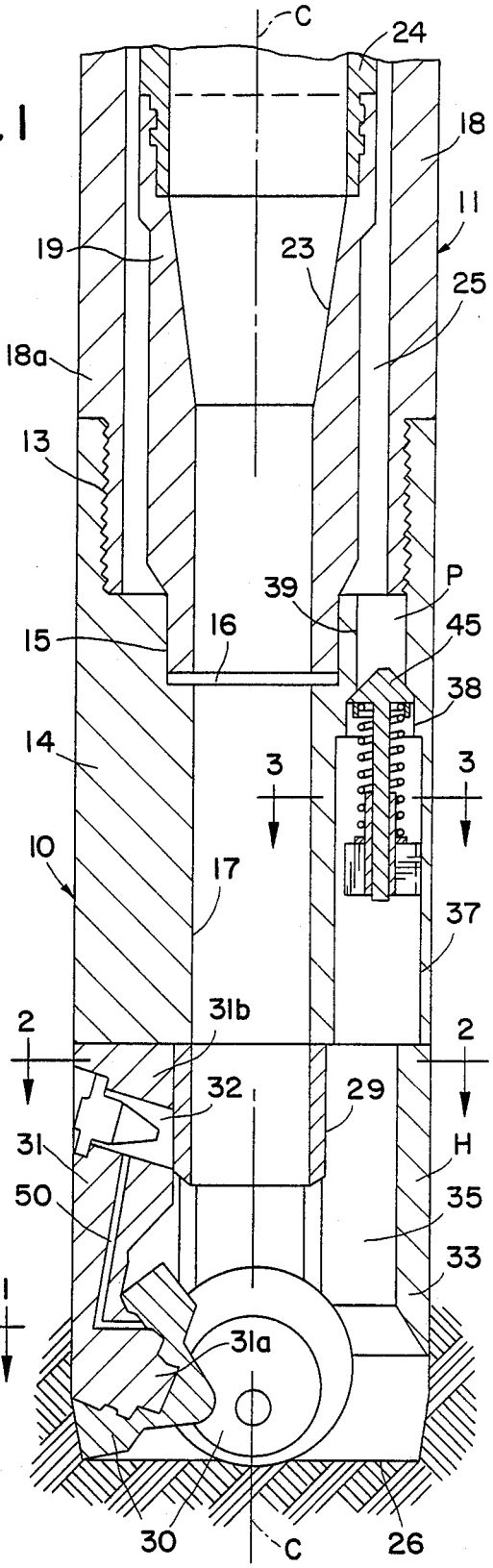
FIG. 1 is a longitudinal cross sectional veiw of the bit assembly of this invention that is generally taken along the line and in the direction of the arrows 1—1 of FIG. 3 other than one arm is shown as having its transverse center axis angularly spaced from that of the other by 90° rather than 120° as is the case with three arms; together with adjacent parts of the drill string.
Figure 3:
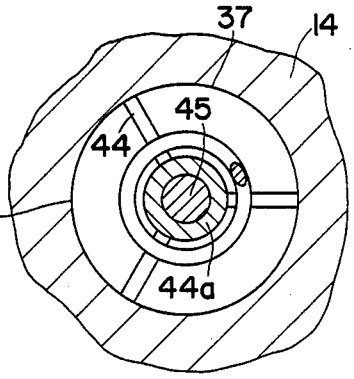
FIG. 3 is a transverse cross sectional view generally taken along the line and in the direction of the arrows 3—3 of FIG. 1.
Figure 2:
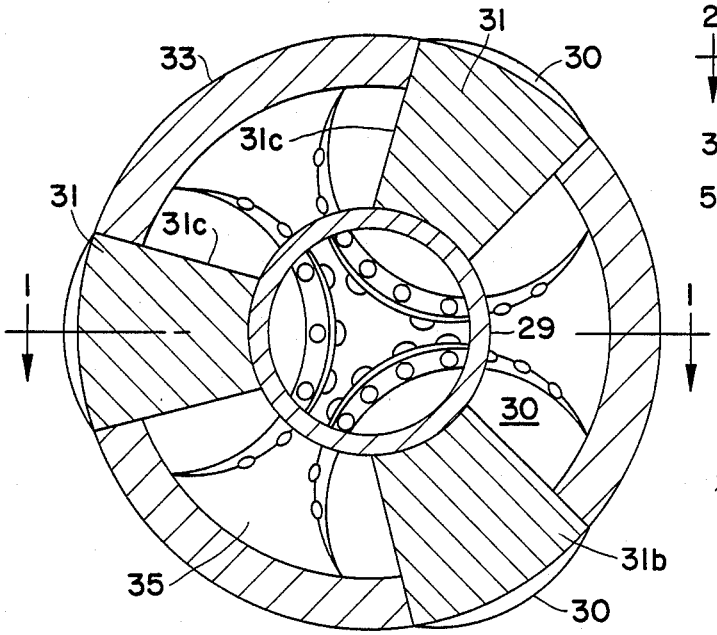
FIG. 2 is a transverse cross sectional view of the cutterhead assembly that is generally taken along the line and in the direction of the arrows 2—2 of FIG. 1.

Secured to each adjacent pair of arms 31 is an arcuate, radial outer tube segment 33 whereby the segments and arms define an axial enclosure that opens to the bit housing inner transverse surface and to the inner transverse surface 26 of the bore hole. Located within the enclosure is a head assembly radial inner tube (skirt) 29 that abuts against the inner transverse surface of the bit housing and is of an inner diameter about the same as that of the housing bore portion 17 to form an inner extension of the housing central bore. As shown, the inner tube 29 has its inner terminal edge located axially outwardly of the outermost parts of the cutters. As may be seen from FIG. 1, the cutter portions that extend inwardly of the segments 33 are inclined such that they will cut a bore hole of a slightly larger diameter than the outer diameter of the combination of arms 31 and segments 33.

Each cutter arm has an outer block end portion 31*b* that abuts against the bit housing and a radial inner arcute surface of a radius of curvature the same as the outer radius of curvature of the inner tube 29 and joined to the inner tube 29 along their coextensive lengths. The portion 31*b* advantageously may extend inwardly of the inner tube 29. Additionally each arm portion 31*b* has angular opposite sides 31*c* that advantageously converge generally radially inwardly toward the bit central axis C-C.

Each bit segment 33 has a radial outer surface of a diameter substantially the same as the outer diameter of the bit housing and an inner diameter substantially greater that the outer diameter of the inner tube 29. Thus the radial outer surfaces of the arms and segments are substantially equally radially spaced from the central axis C-C. The inner terminal arcuate edges of the segments are located axially inwardly of the outermost part of the cutters and advantageously not further inwardly than closely adjacent to the intersection of the axis of rotation of the cutters with the arms radial outer surfaces. Further the axial inner terminal edge of the inner tube 29 is advantageously at least $\frac{1}{4}$ of the axial distance from the bit housing to the outermost parts of the cutters and preferrably even more axially closely adjacent to the outermost parts of the cutters.

The radial adjacent surfaces of the radial inner tube 29 and tube segments 33 together with the side surfaces of arm portions 31 of the arms to which the respective tube segment is joined form a chamber 35 that open outwardly to the inner transverse surface of the bit housing and axially inwardly. That is each chamber 35 opens inwardly angulary between angularly adjacent cutters to allow fluid to flow inwardly and then radially outwardly toward the central axis C-C.

For each of the chambers 35, the bit housing has an axial passage P that at one end opens to the respective chamber 35 in transverse centered relationship thereto and at the opposite end through shoulder 16 to the annular space 25. Thus the passages P are located radially outwardly of the bore portions 15, 17. Each passage includes a maximum diameter inner passage bore portion 37 that opens to the respective chamber, an axial intermediate diameter bore portion 38 and an axial outer minimum diameter bore portion 39 that opens to the clearance space 25 and at the opposite end to the intermediate diameter bore portion to form an inwardly facing shoulder 40 that provides an annular valve seat.

Mounted in each passage is a check valve assembly that includes a spider valve guide 44 mountingly retained in a fixed axial position relative to the bit housing inwardly of shoulder 40. A valve 45 has a valve stem axially slideably extended within the tubular guide portion 44*a* and a generally frustoconical portion that is abuttable against the shoulder 40 for blocking fluid flow outwardly through the passage. The valve stem of the valve is extended through a coil spring 46 that has one end abutting against spider guide radial legs and an opposite end abutting against a retainer washer 47 which in turn abuts against valve frustoconical portion whereby the valve is resiliently urged to its fluid blocking position.

In use fluid under pressure, commonly air, is pumped inwardly under pressure, in the annular space between the drill string radial inner and outer tubes 24, 18 to pass into the clearance space 25 and therefrom into the housing passages P. The pressurized fluid in the passages force the valve members 45 to their check valve open positions and thence flows into the respective cutter assembly chamber 35. With the drill string rotating to dislodge core pieces from the earth formation, the pressurized fluid in exiting from the chambers 35 pass over and between the adjacent parts of the cutters and flows to entrain cut core pieces from the bottom of the bore hole. The entrained pieces are moved radially and axially outwardly to move into and through the cutter head inner tube 29 and thereafter outwardly through the drill string inner tube 24.

Upon discontinuing the flow of fluid inwardly through the annular space between the drill string radial inner and outer tubes 24, 18, the valves 45 are resiliently returned to their closed position. With the valves in their closed position any liquid in the bottom of the bore hole is prevented from flowing inwardly through the Passages P to thereby prevent solid material being conducted into the clearance space 25 and between the radial inner and outer tubes 24, 18 that would result in clogging the passages and annular space 25.

As a result of providing the arms, segments 33, skirt 29, with Pressurized fluid passing through channels 35, deeper bore holes can be cut in a more rapid manner than with present reverse circulation bits now commonly being sold. Further with the present invention the arms may be cut from a conventional annular bit for cutting core pieces, and the cut arm pieces and their cutters may be mounted to provide the cutter head assembly that is described herein.

As an example of the invention, but not otherwise as a limitation thereon, the bit apparatus may have dimensions as follows: the bit housing of an outer diameter of about 6", bore 17 of a diameter of a about 2⅛", passage portions 39, 37 of diameters of about 1" and 1½" respectively, cutter head tube 29 of inner and outer diameters of about 2" and 2⅝ respectively and an axial length of 2¼", and segments 33 of an inner radius and a maximum axial length of about 2 5/16" and 5" respectively. Advantageously the transverse outer circumferential dimension of each of the segments is about as large as, or substantially larger than that of the corresponding dimension of each arm.

Even though the bit has been described as having three cutter arms, it is to be understood that it may have two or more arms with an arcuately curved segment 33 welded to each pair of angularly adjacent arms.

What is claimed is:

1. Reverse circulation rock bit apparatus for having pressurized fluid flow inwardly therethrough, cutting a bore hole that has a transverse inner surface, and have core cuttings entrained in fluid flow outwardly therethrough, and that has a central axis, comprising an axially elongated bit housing having axial opposite inner and outer transverse surfaces and wall means defining a central return bore extending axially therethrough, including opening through the housing transverse surfaces to have entrained cuttings flow thereinto, the central bore including a first bore portion and an axial inner second bore portion that opens through the transverse inner surface, is of a smaller diameter than that of the first bore portion and opens to the first bore portion to form an annular outwardly facing shoulder, a cutter head assembly joined to the housing inner transverse surface to extend inwardly of the housing, the head assembly at least two cutter arms and arcuate segments joined together to cooperatively define an enclosure that opens outwardly to the housing inner transverse surface and has the second bore portion opening thereto, and during use to open to the bore hole inner transverse surface that is cut, there being an arcuate segment extending arcuately between angular adjacent arms and joined thereto and a rotary cutter mounted on each arm to at least in part be located within the enclosure and in part further axially inwardly than the segments, the housing having at least two angular spaced axially extending fluid passages, there being a passage for each cutter arm to conduct pressurized fluid inwardly, the passages having ends opening through the housing transverse inner surface to the enclosure angularly between adjacent arms and in angular spaced relationship to one another, the passages being radially spaced from the central bore second bore portion and opening through the shoulder in angularly spaced relationship, and check valve means in each passage for permitting pressurized fluid flow inwardly through the respective passage and block fluid flow therethrough in an outward direction, the central bore being in fluid communication with the enclosure, each valve means including a valve device and resilient means mounted in the respective passage for resiliently urging the valve device to block fluid flow from the enclosure and outwardly through the passage.

2. The apparatus of claim 1 further characterized in that each passage is in part defined by housing wall portions forming an inwardly facing, annular valve seat, and that each resilient means includes a spider valve guide mounted in the respective passage inwardly of the valve seat and spring means abutting against the valve device and guide member to resiliently urge the valve device to block outward flow through the valve seat, each valve device having a valve stem mounted by the respective valve guide for axial movement and a valve me member mounted by the valve step for abutting against the valve seat to block axial outward flow therethrough.

3. The apparatus of claim 2 further characterized in that each passage is at least in part defined by a first axial inner peripheral wall portion of a given diameter and an outer peripheral second wall portion of a diameter smaller than said given diameter, the valve seat being axially between said inner peripheral wall portion and said second wall portion.

4. The apparatus of claim 1 further characterized in that the cutter head assembly includes an inner tube within the enclosure and mounted to have its interior constitute an axial inward extension of the central bore, the inner tube having an inner terminal edge that extends axially less remote from the housing inner transverse surface than the arcuate segments and being radially spaced from and radially inwardly of the arcuate segments.

5. The apparatus of claim 4 further characterized in that each arm has an outer portion that extends in abutting relationship with at least a major portion of the length of the inner tube and that the cutters have outermost parts, and that the inner tube has an axial inner terminal edge that is at least ¼ of the axial distance from the bit housing inner transverse surface to the outermost parts of the cutters.

6. The apparatus of claim 5 further characterized in that each arm outer portion and the corresponding outer Portion of the angularly adjacent arm in one given angular direction together with one arcuate segment extending therebetween and the inner tube define an enclosed chamber that opens to one of said passages and axially inwardly to discharge pressurized fluid to flow axially inwardly and radially inwardly.

7. The apparatus of claim 6 further characterized in that each passage in transverse cross section is of a maximum cross sectional area that is substantially smaller than the transverse cross sectional area of the chamber to which it opens.

8. The apparatus of claim 6 further characterized in that the central bore includes an inner bore portion having one end opening through the housing inner transverse surface and an opposite end, and an axial intermediate bore portion of a larger diameter than the inner bore portion and an outer bore portion of a larger diameter than the intermediate bore portion and opening thereto, the passages opening to the outer bore portion radially outwardly of the intermediate bore portion.

9. The apparatus of claim 6 further characterized in that it includes a bit connector tube telescopically extended into the intermediate bore portion and that has an axial intermediate portion radially spaced from the housing wall portion defining the outer bore portion to provide an annular clearance space that is adapted to have the pressurized fluid to flow axially inwardly therethrough, the passages opening to the clearance space and that the connector tube opens to the central bore axially inwardly of the outer bore portion.

10. Reverse circulation rock bit apparatus adapted for being attached to a radially outer tube f a dual tube drill stem that includes an inner tube and having pressurized fluid flow inwardly therethrough and for, cutting a bore hole that has a transverse inner surface and having core cuttings entrained in fluid flow outwardly therethrough and that has a central axis, comprising an axially elongated bit housing having axially opposite inner and outer transverse surfaces, a central bore opening through the housing transverse surfaces to have entrained cuttings flow therethrough, the central bore including an axial outer bore portions, an axial intermediate bore portion of a smaller diameter than the axial outer bore portion and opening to the outer bore portion to form an axial outer, axially outwardly facing outer shoulder, and an axial inner bore portion of a smaller diameter than the intermediate bore portion and opening to the intermediate bore portion to form an axial inner, axially outwardly facing shoulder, a cutter head assembly joined to the housing inner transverse surface to extend inwardly of the housing, the head assembly including at least a first and a second cutter arm and arcuate segments joined to the cutter arms to cooperatively define an enclosure that opens to the bore hole and housing inner transverse surfaces, including to the central bore, and during use to open to the bore hole inner transverse surface that is cut, there being an arcuate segment extending between angularly adjacent arms and joined thereto including a first segment between and joined to the first and second arms, the segments having axial outer edges joined to the housing and axial edges, and a rotary cutter mounted on each arm to at least in part be located within the enclosure and in part further axially inwardly than the inner edges of the segments, the housing having an axial passage for each cutter arm to conduct pressurized fluid, the pa sages being angularly spaced from one another, radially spaced from the central axis and opening through the axial outer shoulder and through the housing transverse inner surface to the enclosure angularly between the adjacent arms, each passage having a valve member therein and mounted for movement between a first position permitting pressurized fluid flow inwardly through the respective passage and a second position blocking fluid flow therethrough in an outward direction, valve member mounting means mounted by the housing in each passage for resiliently urging the respective valve member to its blocking position, and a bit connector tube having an inner end portion telescopically extended into the central bore intermediate portion and an axial intermediate portion radially spaced from the outer bore portion to provide an annular clearance space that is adapted to have pressurized fluid flow axially inwardly therethrough to the openings of the passages through the axial outer shoulder, the tube opening to the central bore inner portion.

* * * * *

UNITED STATES PATENT AND TRADEMARK OFFICE

CERTIFICATE OF CORRECTION

PATENT NO. : 4,823,890

DATED : April 25, 1989

INVENTOR(S) : Alan F. Lang

It is certified that error appears in the above-identified patent and that said Letters Patent are hereby corrected as shown below:

Column 4, line 65, change "Passages" to --passages--.

Column 5, line 2, change "Pressurized" to --pressurized--; line 16, change "2 5/8" to --2 3/8--; and line 45, after "assembly" insert --including--.

Column 6, line 15, delete "me "; and line 44 change "Portion" to --portion--.

Column 7, line 8, change "f" to --of--; and line 18, change "portions" to --portion--.

Column 8, line 6, before "edges", insert --inner--; and line 10, change "pa sages" to passages.

Signed and Sealed this

Twenty-eighth Day of April, 1992

*Attest:*

HARRY F. MANBECK, JR.

*Attesting Officer*

*Commissioner of Patents and Trademarks*